US006220146B1

(12) United States Patent
Ota et al.

(10) Patent No.: US 6,220,146 B1
(45) Date of Patent: Apr. 24, 2001

(54) SINGLE-HEADED-PISTON TYPE REFRIGERANT COMPRESSOR WITH MEANS FOR PREVENTING ROTATION OF THE PISTON ABOUT ITS OWN AXIS WITHIN THE CYLINDER BORE

(75) Inventors: Masaki Ota; Keiichi Kato; Taku Adaniya; Kenta Nishimura, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/390,726

(22) Filed: Sep. 7, 1999

(30) Foreign Application Priority Data

Sep. 16, 1998 (JP) ..... 10-261928

(51) Int. Cl.[7] ..... F16J 15/18
(52) U.S. Cl. ..... 92/165 PR; 412/222.1
(58) Field of Search ..... 417/269, 222.2, 417/222.1, 222; 92/165 R, 71, 12.2, 165 PR

(56) References Cited

U.S. PATENT DOCUMENTS

| | | | | |
|---|---|---|---|---|
| 4,801,248 | * | 1/1989 | Tojo et al. | 417/222 |
| 5,228,841 | * | 7/1993 | Kimura et al. | 417/222.2 |
| 5,304,042 | * | 4/1994 | Kayukawa et al. | 417/222.1 |
| 5,615,599 | * | 4/1997 | Terauchi | 92/165 R |
| 5,899,135 | * | 5/1999 | Kanou et al. | 92/71 |
| 5,934,170 | * | 8/1999 | Morita | 92/12.2 |

FOREIGN PATENT DOCUMENTS

| | | |
|---|---|---|
| 6-346844 | 12/1994 | (JP) . |
| 8-109874 | 4/1996 | (JP) . |
| 8-177733 | 7/1996 | (JP) . |
| 8-254180 | 10/1996 | (JP) . |
| 8-296533 | 11/1996 | (JP) . |
| 9-250451 | 9/1997 | (JP) . |

* cited by examiner

*Primary Examiner*—Timothy S. Thorpe
*Assistant Examiner*—Ehud Gartenberg
(74) *Attorney, Agent, or Firm*—Woodcock Washburn Kurtz Mackiewicz & Norris LLP

(57) ABSTRACT

A single headed piston type refrigerant compressor having a cylinder block forming therein a plurality of cylinder bores receiving a plurality of single-headed pistons for reciprocation therein, and a front housing joined to the cylinder block to define a crank chamber for receiving therein a cam plate. An extended bore-forming portion of the cylinder block having partial cylindrical guide surfaces each being continuous with the corresponding cylinder bore and capable of being in slide contact with the piston head portion of the single-headed piston and the outer circumference of a shoe-holding portion of the single-headed piston is formed by extending a peripheral portion of a front end of the cylinder block into the crank chamber. A projecting portion formed on each single head piston protrudes from a side end surface of the shoe-holding portion extending behind the piston head portion into the crank chamber. Therefore, the extended bore-forming portion can additionally be extended toward the crank chamber by a length corresponding to the distance of dislocation of the projecting portion into a space on the front side of the crank chamber to increase additionally the length of contact of the piston with cylinder bore.

6 Claims, 3 Drawing Sheets

SINGLE-HEADED-PISTON TYPE REFRIGERANT COMPRESSOR WITH MEANS FOR PREVENTING ROTATION OF THE PISTON ABOUT ITS OWN AXIS WITHIN THE CYLINDER BORE

BACKGROUND OF THE INVENTION

1. Field of the Invention

The present invention relates to a single-headed-piston type refrigerant compressor and, more specifically, to a single-headed-piston type refrigerant compressor provided with a plurality of single-headed pistons each being engaged by a pair of shoes with a cam plate mounted around a drive shaft to be moved linearly in a corresponding cylinder bore to compress a gas and an improved piston-bore fitting construction capable of both preventing the single-headed piston from rotating about its own axis and increasing a length of smooth slide-engagement between the piston and the corresponding cylinder bore.

2. Description of the Related Art

A conventional single-headed-piston type refrigerant compressor is provided with a plurality of single-headed pistons capable of being moved linearly in a plurality of parallel cylinder bores arranged on one side of the compressor body, a drive shaft, and a cam plate mounted around the drive shaft for rotation together with the drive shaft. Each of the single-headed pistons is engaged with the cam plate via a pair of shoes.

The single-headed-piston type refrigerant compressor includes a cylinder block in which the plurality of parallel cylinder bores are formed, a front housing covering a front end of the cylinder block and defining a crank chamber therein, and a rear housing defining a suction chamber and a discharge chamber and covering the rear end of the cylinder block. The drive shaft is rotatably supported by the cylinder block and the front housing.

When the cam plate of the single-headed-piston type refrigerant compressor is rotated to reciprocate the single-headed pistons, the cam plate exerts a force through the shoes to each single-headed piston, which has an essential axial component force effective in reciprocating the piston in the cylinder bore, and a rotative component force tending to turn the piston on its central axis. If the piston is turned about its central axis through a large angle by the rotative component force, a shoe-holding-portion of the piston comes, at a part thereof, into contact with a peripheral part of an outer circumference of the cam plate and, accordingly, the reciprocation motion of the piston is adversely affected.

Japanese Unexamined Patent Publication No. 8-109874 discloses a means for preventing the piston from rotating about its own central axis in which a partial circular projecting portion for preventing the piston from rotating is formed in a back face of the shoe-holding-portion of the piston to radially project toward an outer circumference of the piston. The outer surface of the partial circular projecting portion of the shoe-holding-portion of the piston is held in contact with an inner wall face of the housing defining the crank chamber, so that the rotation of the piston about its own central axis may be prevented.

Nevertheless, in the known single-headed-piston type refrigerant compressor, the cam plate exerts a side force tending to force the piston head portion in a radial direction of the compressor through the shoes during compressing and discharging strokes of the piston in addition to the axial component force and the rotative component force. The side force provides adverse affects on the smooth reciprocation of the piston and even produces a moment of force tilting the piston and causing abnormal abrasion of both the cylindrical outer circumference of the piston and the inner wall of the cylinder bore.

The moment of force tending to tilt the piston may be reduced by increasing the length of piston and that of the cylinder bore in order to increase a length of contact between the cylindrical outer circumference of the piston and the cylindrical inner wall of the cylinder bore. However, if a total length of the piston is increased to obtain a sufficient length of contact of the piston with the cylinder bore, the axial length of the cylinder bore must be correspondingly increased in a direction toward the rear housing for the purpose of securing a predetermined stroke volume of the piston. Consequently, an overall axial length of the compressor (i.e., the overall size of the compressor) must be increased.

On the other hand, if the length of a contact portion of the piston is increased by extending the cylinder bore in a direction toward the crank chamber opposing to the direction toward the rear housing, an amount of extension of the cylinder bore must be restricted by a relation between the afore-mentioned projecting portion of the piston and a cylinder-bore-forming portion of the cylinder block. Namely, it must be taken into consideration the fact that when the piston is moved to its top dead center within the cylinder bore, occurrence of mechanical interference between the projecting portion of the piston and the cylinder-bore-forming portion of the cylinder block must be avoided.

SUMMARY OF THE INVENTION

An object of the present invention is, therefore, to solve the foregoing problems encountered by the conventional single-headed-piston type refrigerant compressor.

Another object of the present invention is to provide a single-headed-piston type refrigerant compressor provided with single-headed pistons provided with a rotation-preventing portion and having a contact portion of the greatest possible length in contact with a cylindrical wall of the corresponding cylinder bore, respectively, and being able to achieve a smooth piston motion and to suppress abrasion of the outer circumference of the pistons and the corresponding respective cylinder bores.

A further object of the present invention is to provide a single-headed-piston type refrigerant compressor internally provided with a means for achieving smooth piston motion without requiring an increase in the overall size of the refrigerant compressor.

In accordance with the present invention, there is provided a single-headed-piston type refrigerant compressor which comprises:

a cylinder block provided with a plurality of parallel cylinder bores formed therein and having front and rear ends; a front housing covering the front end of the cylinder block and defining a crank chamber therein;

a drive shaft supported on the cylinder block and the front housing to be rotatable about an axis of rotation;

a rear housing covering the rear end of the cylinder block and defining, therein, a suction chamber for a refrigerant before compression and a discharge chamber after compression;

a cam plate arranged around the drive shaft to be rotatable together with the drive shaft; and a plurality of single-headed pistons fitted for linear motion in the plurality of cylinder bores, respectively, each being engaged, via a pair of shoes, with the cam plate to be moved linearly in one of the cylinder bores in response to rotation of the cam plate, wherein each of the single-headed pistons comprises:

a piston head portion sliding in the cylinder bore and having a compressing end to compress the refrigerant and a base end opposite to the compressing end;

a shoe-holding portion arranged adjacent to the base end of the piston head portion and formed as a substantially longitudinal U-shape-cross-sectional portion having opposing inner faces defining a pair of engaging recesses to receive the pair of shoes therein; and a projecting portion formed as a rotation-preventing portion for preventing the single-headed piston from turning about its own axis, the projecting portion extending from the shoe-holding portion in a direction away from the piston head portion, and having a rotation-preventing face partially protruding in a radially outward direction beyond an outer circumference of the piston head portion so as to be in contact with a stationary part of the compressor to prevent the single headed piston from turning about its own axis, and wherein the cylinder block comprises:

an extended bore-forming portion defining a cylindrical guide surface able to permit at least the outer circumference of the piston head portion to slidably move thereon, the extended bore-forming portion being arranged to extend from a peripheral portion of the front end of the cylinder block toward the crank chamber.

In the described single-headed-piston type refrigerant compressor, the outer circumferences of the piston head portions of the respective single-headed pistons can slide along the cylindrical guide surfaces of the extended bore-forming portion of the cylinder block, and a part of side force acting on the piston is born by the extended bore-forming portion. Therefore, the extended bore-forming portion exercises the same effect as the extension of the cylinder bores toward the crank chamber (substantial increase in the length of the contact portion of the piston) and hence the moment of force produced by the side force can be reduced. The projecting portion having the rotation-preventing surface partially protruding in a radial direction beyond the outer circumference of the piston head portion so as to be in contact with other member to prevent the piston from rotating about its own central axis is formed so as to project from the shoe-holding portion in a direction away from the piston head portion. Therefore, the extended bore-forming portion of the cylinder block can additionally be extended toward the crank chamber by a length corresponding to the distance of dislocation of the projecting portion from the back surface of the shoe-holding portion into a space on the front side of the crank chamber to additionally increase the length of contact of the pistons with the corresponding cylinder bores.

Accordingly, the side force acting on the piston can effectively be reduced even in a state where the piston is moved to its bottom dead center while decreasing the length of contact of the piston with the cylinder bore to the minimum. Therefore, the single-headed pistons can surely smoothly reciprocate and, accordingly, abrasion of the outer circumferences of the piston head portions of the respective single-headed pistons and the cylinder bores can effectively be suppressed.

Since the extended bore-forming portion of the cylinder block can contribute to an increase in the length of contact between the pistons and the corresponding cylinder bores, the axial length of the piston head portion and hence the axial length of the cylinder bore except for the extended bore-forming portion can be reduced. Thus, a reduction in the overall axial length of the refrigerant compressor can be obtained.

If the crank chamber of the compressor has a space that permits the extension of the projecting portion of the piston toward the front side (of the crank chamber) from the back surface of the shoe-holding portion of the piston, the axial length of the compressor need not be increased when the projecting portion is projected into a space on the front side of the shoe-holding portion.

In the single-headed-piston type refrigerant compressor in accordance with the present invention, it is preferable that the shoe-holding portion is provided in its back surface with a partial outer cylindrical face continuous with the outer circumference of the piston head portion, and that the partial outer cylindrical face can slidably move along the piston guide surface of the extended bore-forming portion of the cylinder block.

In the single-headed-piston type refrigerant compressor thus constructed, since the outer cylindrical face of the shoe-holding portion slides along the piston guide surface of the extended bore-forming portion of the cylinder block, the extended bore-forming portion bears a part of the side force acting on the piston when the piston is at the top dead center thereof, whereby the side force acting on the piston can effectively be reduced.

Preferably, the single-headed-piston type refrigerant compressor is designed so that the projecting portion of the single-headed piston is spaced the smallest possible distance apart from the extended bore-forming portion when the single-headed piston comes to its top dead center. The extended bore-forming portion is extended by the greatest possible length toward the crank chamber to increase the length of contact of the piston with the corresponding cylinder bore to the greatest possible extent.

Accordingly, the side force acting on the piston can effectively be reduced, the piston is able to achieve a smoother operation, and the abrasion of the outer circumference of the piston head as well as the cylinder bore can effectively be suppressed.

The axial length of the piston head portion and hence the axial length of the cylinder bore excluding the extended bore-forming portion can be reduced, which contributes greatly to a reduction of the overall size of the single-headed-piston type refrigerant compressor.

The single-headed-piston type refrigerant compressor in accordance with the present invention preferably comprises a lug plate to which the cam plate is engaged so as to be turned forward and rearward via a hinge unit disposed in a front region of the crank chamber and fixedly mounted on the drive shaft, and the projecting portion of each single-headed piston formed as a rotation-preventing means, when the piston is positioned at its bottom dead center with the cam plate inclined at its maximum inclination, lies on the radially outer side of the lug plate and overlaps the lug plate with respect to axial direction, and the projecting portion of the single-headed piston, when the single-headed piston is positioned at its bottom dead center with the cam plate at its maximum inclination, is spaced the smallest possible distance apart from an inner wall surface of the front housing.

In a state where the cam plate is inclined at its maximum angle of inclination and the single-headed piston is at its bottom dead center, the projecting portion is at a position nearest to the front end of the crank chamber. In this compressor, the projecting portion lies on the radially outer side of the lug plate and overlaps the lug plate with respect to axial direction. Consequently, a space permitting the projection of the projecting portion into a space on the front side of the shoe-holding portion can be secured without increasing the axial length of the crank chamber. Therefore, the overall size of the compressor need not be increased even if the projecting portion is projected into the space on the front side of the shoe-holding portion.

This compressor is designed so that the projecting portion is spaced the smallest possible distance apart from the inner wall surface of the front housing, i.e., the front end region of the crank chamber when the projecting portion is moved to its front end position in the crank chamber. Therefore, the relation between the projecting portion and the front end of the crank chamber with the cam plate inclined at its maximum inclination and the piston at its bottom dead center enables reduction of the axial length of the crank chamber to the smallest possible extent, which contributes to a reduction of the overall size of the single-headed-piston type compressor.

BRIEF DESCRIPTION OF THE DRAWINGS

The above and other objects, advantages and features of the present invention will become more apparent from the ensuing description of the preferred embodiment of the present invention illustrated in the following drawings, wherein.

DESCRIPTION OF THE PREFERRED EMBODIMENTS

Figure 1:
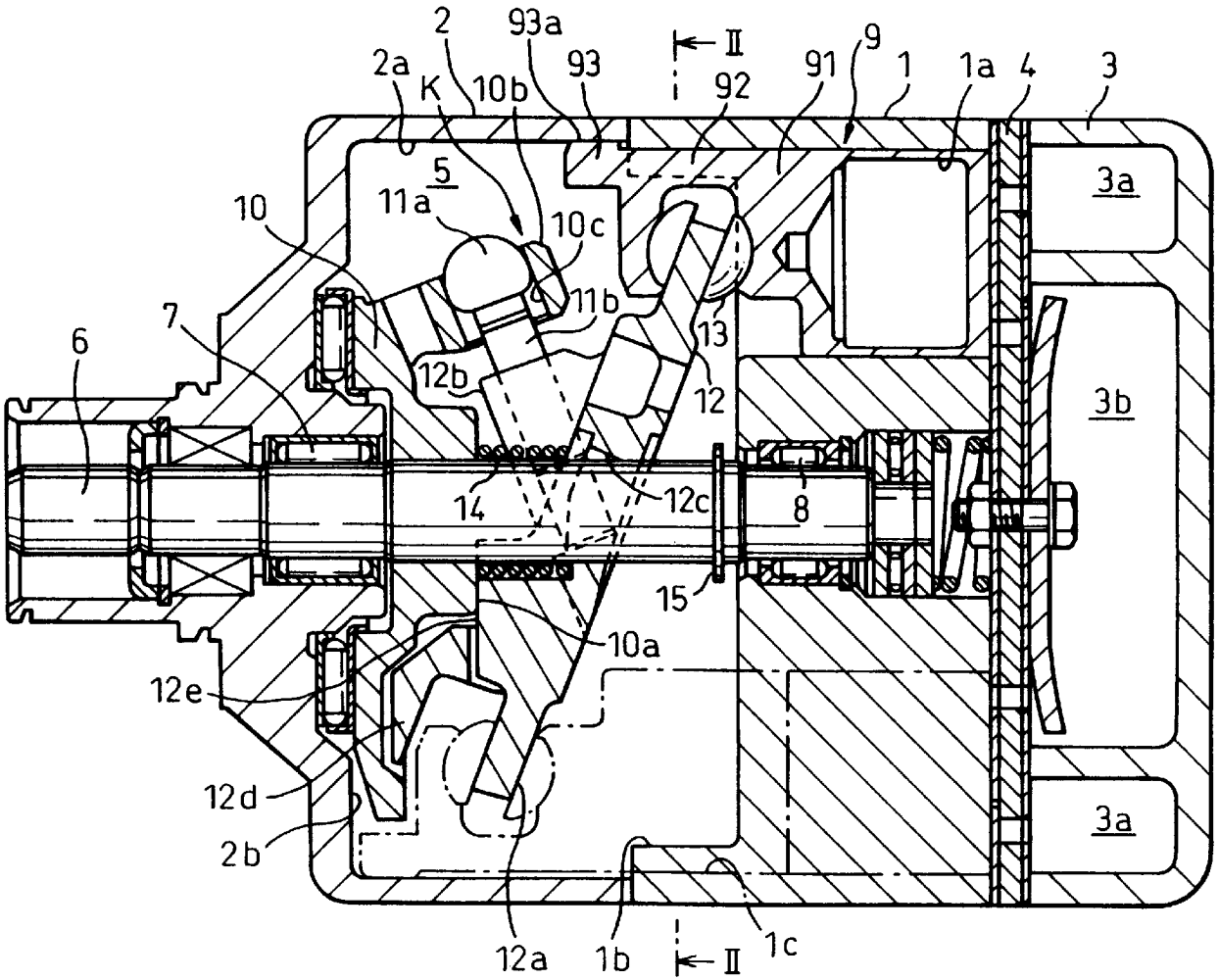
FIG. 1 is a longitudinal cross-sectional view of a single headed piston type refrigerant compressor according to an embodiment of the present invention.
Figure 2:
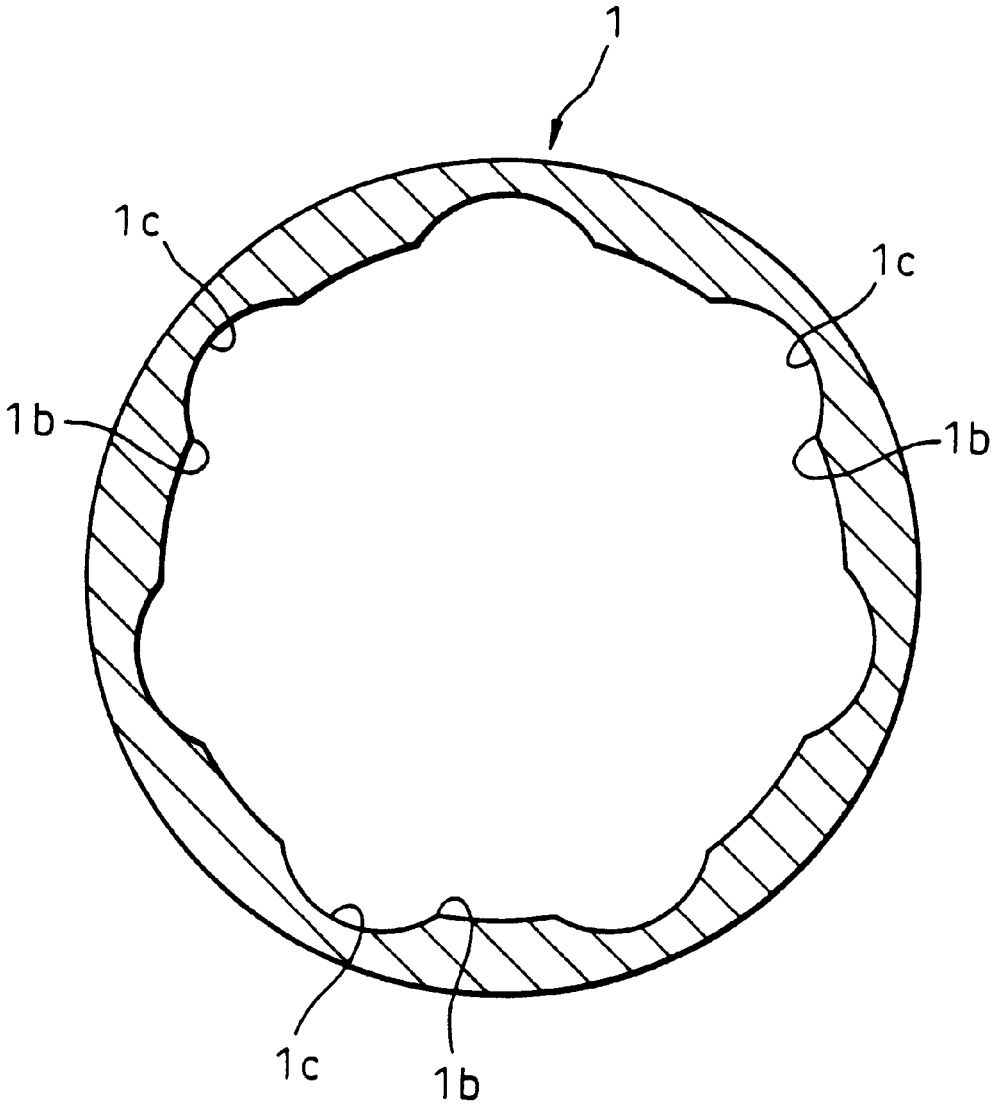
FIG. 2 is a sectional view of a cylinder block incorporated in the refrigerant compressor, taken along the line II—II in FIG. 1.

Referring to FIG. 1, a single-headed-piston type refrigerant compressor according to a preferred embodiment of the present invention has a cylinder block 1. A front end of the cylinder block 1 is covered with a front housing 2, and a rear end of the same cylinder block 1 is covered with a rear housing 3. A valve plate 4 is held on the rear end of the cylinder block 1. The cylinder block 1, the front housing 2, the rear housing 3 and the valve plate 4 are fastened together with through screw bolts, not shown. A drive shaft 6 is extended axially in a crank chamber 5 defined by the cylinder block 1 and the front housing 2 and is supported for rotation via radial bearings 7 and 8 held on the front housing 2 and the cylinder block 1. The drive shaft 6 has a front end part connected by an electromagnetic clutch and a transmission mechanism to an automotive engine. The cylinder block 1 is provided with a plurality of cylinder bores 1*a* arranged around the drive shaft 6. A single-headed piston 9 is fitted in each cylinder bore 1*a* so as to be reciprocated therein.

A peripheral section of an end part of the cylinder block 1 on the side of the crank chamber 5 is projected axially into the crank chamber 5 to form an extended bore-forming portion 1*b*. The extended bore-forming portion 1*b* of the cylinder block 1 is provided in its inner circumference with segmental piston guide surfaces 1*c* continuous with the surfaces of the cylinder bores 1*a*, respectively. The outer side surface 91*b* of a piston head portion 91, and an outer slide surface 92*b* of a shoe-holding portion 92, which will be described later, slide along the segmental piston guide surface 1*c* of the extended bore-forming portion 1*b*.

A lug plate 10 is disposed in the front region of the crank chamber 5 and is fixedly mounted on the drive shaft 6 for synchronous rotation. A thrust bearing is interposed between an inner wall of the front housing 2 and the lug plate 10. A cam plate 12 is mounted on the drive shaft at a position behind the lug plate 10. The cam plate 12 is pivoted to the lug plate 10 via a hinge mechanism K so that the cam plate 12 may be turned about a pivot, in an axial direction, to change its angle of inclination with respect to a plane perpendicular to the axis of rotation of the drive shaft 6. The cam plate 12 is constantly urged backward, i.e., toward a position where the cam plate 12 is inclined at a minimum angle of inclination, by a compression spring 14 arranged between the lug plate 10 and the cam plate 12.

Smooth, annular slide faces 12*a* are formed in peripheral regions of the opposite side surfaces of the cam plate 12. Hemispherical shoes 13 are in slide contact with the annular slide faces 12*a*, and the single headed pistons 9 are engaged via the shoes 13 with the cam plate 12.

Figure 3:
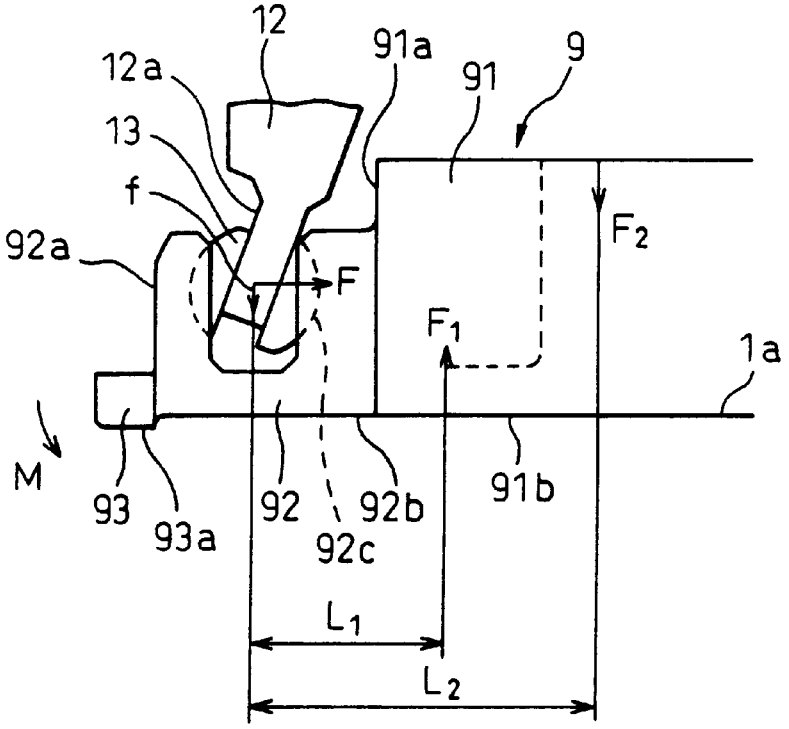
FIG. 3 is a side elevation of a single headed piston incorporated in the refrigerant compressor shown in FIG. 1.
Figure 4:
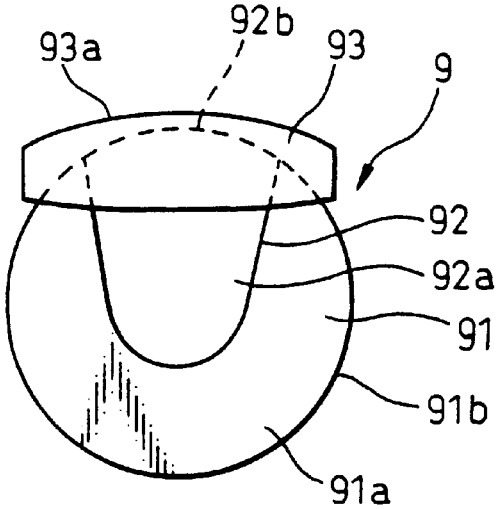
FIG. 4 is a rear view of a single-headed piston included in the refrigerant compressor shown in FIG. 1.

As shown in FIGS. 3 and 4, the single-headed piston 9 has a cylindrical piston head portion 91 slidable in the cylinder bore 1*a*, a shoe-holding portion 92 contiguous with the base end 91*a* of the piston head portion 91 and having a substantially U-shaped longitudinal cross-section, and a projecting portion 93 extending frontward from a front end surface 92*a* of the shoe-holding portion 92 and having a cylindrical surface portion projecting radially outward from a cylindrical plane forming the outer circumference of the piston head portion 91. Namely, it should be noted that when each single-headed piston 9 is fitted in the corresponding cylinder bore 1*a*, the cylindrical surface portion of the projecting portion 93 is located radially outside an outer circumference 91*b* of the piston head portion 91 with respect to the center of the entire compressor body of the refrigerant compressor. However, the shoe-holding portion 92 of the piston 9 is formed not to be projected outward from a cylindrical plane including the outer circumference 91*b* of the piston head portion 91, so that the shoe-holding portion 92 may not interfere with the extended bore-forming portion 1*b* of the cylinder block 1 when the single-headed piston 9 is at its top dead center within the cylinder bore 1*a*. A cylindrical surface portion, i.e., a back surface of the shoe-holding portion 92 arranged radially in an outward region of the compressor functions as a segmental outer circumference 92*b* continuous with the outer circumference 91*b* of the piston head portion 91. A pair of engaging recesses 92*c* are formed in the opposite inner surfaces of the shoe-holding portion 92 of each single-headed piston 9. Convex, spherical portions of the pair of shoes 13 are engaged to be slidably fitted in the engaging recesses 92*c*, respectively. The cylindrical surface portion of the projecting portion 93 arranged in an outward region of the compressor functions as a slidable rotation-preventing surface 93*a* held in slidable contact with the inner wall surface 2*a* of the front housing 2 to prevent the single-headed piston 9 from turning about its central axis. The slidable rotation-preventing surface 93*a* has a radius of curvature greater than that of the outer circumference 91*b* of the piston head portion 91. The slidable rotation-preventing surface 93*a* projects radially outward from a curved plane including the outer circumference 91*b* of the piston head portion 91.

A pair of brackets 12*b* protrude from a side surface of the cam plate 12 on the side of the lug plate 10 at positions on the inner side of the slide face 12*a* so as to straddle the top dead center of the cam plate 12. Base end portions of guide pins 11*b* are fixed to the brackets 12*b*, respectively. Each guide pin 11*b* is provided at its free end with a spherical head 11*a*. In this compressor, the brackets 12*b*, the guide pins 11*b* and the spherical heads 11*a* are components of the hinge mechanism K.

The cam plate 12 is provided in its central part with a crooked through hole 12*c* formed so as to permit a variation of the inclination of the cam plate 12. A counterweight 12*d* is extended radially outward from the axis of the drive shaft 6 in the bottom dead center region in the side surface of the cam plate 12 on the side of the lug plate 10 and is fastened to the cam plate 12 by rivets or the like. The counterweight 12*d* is formed so as not to interfere with the shoe 13 on the side of the lug plate 10 and so as to cover the slide face 12*a*. The cam plate 12 has a front end surface 12*e* formed nearer to the center than the counterweight 12*d*. The front end surface 12*e* comes into contact with the rear end surface 10*a* of the lug plate 10 to limit the maximum inclination of the cam plate 12. A counter-bored portion formed in the rear end surface of the cam plate 12 comes into contact with a circlip or a snap ring 15 snapped on the drive shaft 6 to limit the minimum inclination of the cam plate 12.

Support arms 10*b*, which are components of the hinge mechanism K, project axially backward from upper parts of the lug plate 10 so as to correspond to the guide pins 11*b*, respectively. Guide holes 10*c* are formed in end portions of the support arms 10*b* in parallel to a plane defined by the axis of the drive shaft 6 and the top dead center of the cam plate 12 so as to approach the axis of the drive shaft 6. The direction of the guide holes 10*c* is determined so that the position of the top dead center of the single headed piston 9 remains fixed regardless of the variation of the inclination of the cam plate 12. The spherical heads 11*a* of the guide pins 11*b* are received in the guide holes 10*c* in sliding contact with the surfaces of the guide holes 10*c*, respectively.

A suction chamber 3*a* and a discharge chamber 3*b* are defined in the rear housing 3. The valve plate 4 is provided with suction ports and discharge ports at positions respectively corresponding to the cylinder bores 1*a*. A compression chamber formed between the valve plate 4 and each single headed piston 9 communicates with the suction chamber 3*a* by means of the suction port and with the discharge chamber 3*b* by means of the discharge port. A suction valve for opening and closing each suction port and a discharge valve for opening and closing each discharge port are attached to the valve plate 4.

The rear housing 3 is provided with a displacement control valve, not shown. The displacement control valve adjusts the pressure in the crank chamber 5 by opening and closing a supply passage through which a refrigerant gas is supplied from the discharge chamber 3*b* into the crank chamber 5. The cylinder block 1 is provided with an extraction passage with restrictor extending between the crank chamber 5 and the suction chamber 3*a*. The displacement control valve adjusts the pressure in the crank chamber 5 according to suction pressure to control the inclination of the cam plate 12 and, consequently, the stroke of the single headed pistons 9 is changed to adjust the discharge capacity.

This compressor is designed so that the projecting portion 93 of the single headed piston 9 at the top dead center (the upper piston in FIG. 1) is at the least possible axial distance from the extended bore-forming portion 1*b*. Namely, substantially almost all of the outer circumference 92*b* of the shoe holding portion 92 is in sliding contact with the piston guide surface 1*c* of the extended bore-forming portion 1*b*. The extended bore-forming portion 1*b* is extended toward the crank chamber 5 by the greatest possible length to increase the length of the contact section of the piston 9 to the greatest possible extent. Consequently, the axial length of the piston head portion 91 and hence the axial length of the bores 1*a* excluding the extended bore-forming portion 1*b* can be reduced according to the length of extension of the extended bore-forming portion 1*b*, which contributes to the reduction of the overall axial length of the compressor.

The projecting portion 93 of the single-headed piston 9 at the bottom dead center with the cam plate 12 inclined at the maximum inclination (the lower piston indicated by chain lines in FIG. 1) lies on the radially outer side of the lug plate 10 and overlaps the lug plate 10 with respect to axial direction (the front end surface of the projecting portion 93 substantially coincides with the front end surface of the lug plate 10 with respect to axial direction); that is, the projecting portion 93 of the single-headed piston 9 lies on the radially outer side of the lug plate 10 and overlaps the front end of the lug plate 10 with respect to axial direction when the same is at its front end position in the crank chamber 5. Consequently, a space permitting the projection of the projecting portion 93 into a space on the front side of the shoe-holding portion 92 can be secured without increasing the axial length of the crank chamber 5. Therefore, the overall axial length of the compressor need not be increased even if the projecting portion 93 is projected into the space on the front side of the shoe-holding portion 92. This compressor is designed so that the projecting portion 93 is spaced the least possible distance apart from the inner surface 2*b* of the front wall of the front housing 2 when the projecting portion 93 is moved to its front end position in the crank chamber 5. Therefore, the relation between the projecting portion 93 and the front end of the crank chamber 5 with the cam plate 12 inclined at its maximum inclination and the piston 9 at its bottom dead center enables the reduction of the axial length of the crank chamber to the least possible extent, which contributes to the reduction of the overall axial length of the compressor.

Since the length of the contact section of the single-headed piston 9 is thus increased, a side force acting on the single-headed piston 9 during the compression and discharge strokes can more effectively be reduced, so that a smoother piston operation can be achieved and the abrasion of the slide surfaces of the piston head portions 91 and the bores 1*a* can effectively be suppressed.

The relation between moment acting on the single-headed piston 9, and the length of the contact section of the single-headed piston 9 and side force acting on the single-headed piston 9 will be explained hereinafter.

Referring to FIG. 3, the single-headed piston 9 exerts a large inertial force on the cam plate 12 when the stroke of the single-headed piston 9 changes from the suction stroke to the discharge stroke. Consequently, an axial component force "F" and a component force "f" perpendicular to the axial component force "F" are exerted through the shoe 13 to the single-headed piston 9. Therefore, a moment "M" of force, indicated by the arrow M, tends to tilt the single-headed piston 9 moving in the cylinder bore 1*a* in a stroke for compression and discharge, and side forces $F_1$ and $F_2$ act on the single-headed piston 9. Problems attributable to the side forces $F_1$ and $F_2$ are significant when the length of the contact section of the single-headed piston 9 decreases to its minimum, i.e., when the single-headed piston 9 is at the bottom dead center with the cam plate 12 inclined at the maximum inclination.

The relation between the component force f perpendicular to axial direction, the side force $F_1$ borne by the edge of the cylinder bore 1*a* and the side force $F_2$ born by the edge of the front end of the piston head portion 91 can be expressed by Expressions (1) and (2) as set forth below.

$$f+F_2=F_1 \quad (1)$$

$$F_1 \cdot L_1=F_2 \cdot L_2 \quad (2)$$

where $L_1$ is the distance between the center of the sphere including the shoes 13 and the edge of the cylinder bore 1*a*, and $L_2$ is the distance between the center of the sphere including the shoes 13 and the edge of the front end of the piston head portion 91.

Therefore, $$F_1=L_2 \cdot f/(L_2-L_1) \quad (3)$$

$$F_2=L_1 \cdot f/(L_2-L_1) \quad (4)$$

It is known from Expressions (3) and (4) that the side forces $F_1$ and $F_2$ can be reduced by increasing the value of $(L_2-L_1)$, i.e., by increasing the length of the contact section of the single-headed piston 9.

What we claim is:

1. A single-headed-piston type refrigerant compressor comprising:

a cylinder block provided with a plurality of parallel cylinder bores formed therein and having front and rear ends;

a front housing covering the front end of said cylinder block and defining a crank chamber therein;

a drive shaft supported on said cylinder block and said front housing to be rotatable about an axis of rotation;

a rear housing covering the rear end of said cylinder block and defining, therein, a suction chamber for a refrigerant before compression and a discharge chamber after compression; a cam plate arranged around said drive shaft to be rotatable together with said drive shaft; and a plurality of single-headed pistons fitted for linear motions in said plurality of cylinder bores, respectively, each being engaged, via a pair of shoes, with said cam plate to be moved linearly in one of said cylinder bores in response to rotation of said cam plate, wherein each of said single-headed pistons comprises:

a piston head portion sliding in said cylinder bore and having a compressing end to compress the refrigerant and a base end opposite to said compressing end;

a shoe-holding portion arranged adjacent to said base end of said piston head portion and formed as a substantially longitudinal U-shape-cross-sectional portion having opposing inner faces defining a pair of engaging recesses to receive said pair of shoes therein; and a projecting portion formed as a rotation-preventing portion for preventing the single-headed piston from turning about its own axis, said projecting portion extending from said shoe-holding portion in a direction away from said piston head portion, and having a rotation-preventing face partially protruding in a radially outward direction beyond an outer circumference of said piston head portion so as to be in contact with a stationary part of said compressor to prevent said single headed piston from turning about its own axis, and wherein said cylinder block comprises:

an extended bore-forming portion defining a cylindrical guide surface able to permit at least said outer circumference of said piston head portion to slidably move thereon, said extended bore-forming portion being arranged to extend from a peripheral portion of said front end of said cylinder block toward said crank chamber.

2. The single-headed-piston type refrigerant compressor according to claim 1, wherein said shoe-holding portion of said each single-headed piston is provided with a partial outer cylindrical circumference formed at a back face thereof to be continuous with said outer circumference of said piston-head portion, said partial outer cylindrical circumference being able to slide along said cylindrical guide surface of said extended bore-forming portion of said cylinder block.

3. The single-headed-piston type refrigerant compressor according to claim 1, wherein the length of the extended bore-forming portion has a length thereof determined so that said projecting portion of said each single-headed piston is spaced the smallest possible distance apart from said extended bore-forming portion when said each single-headed piston comes to a top dead center thereof with respect to said corresponding cylinder bore.

4. The single-headed-piston type refrigerant compressor according to claim 1, wherein said compressor comprises a lug plate disposed in a front end region of said crank chamber and fixedly mounted on said drive shaft to be pivotally engaged with said cam plate via a hinge means, said hinge means permitting said cam plate to turn thereby to change an angle of inclination, and wherein said projecting portion of said single-headed piston is arranged to extend on a radially outer side of said lug plate while overlapping said lug plate when said each single-headed piston comes to a bottom dead center thereof with said cam plate being inclined at the maximum angle of inclination thereof, said projecting portion of said each single-headed piston being spaced the shortest possible distance apart from an inner wall face of said front housing when said each single-headed piston comes to the bottom dead center thereof with said cam plate being held at the maximum angle of inclination.

5. The single-headed-piston type refrigerant compressor according to claim 1, wherein said stationary part with which said projecting portion of said each single-headed piston is brought into contact to prevent rotation of said each single-headed piston about its axis comprises a portion of an inner wall face of said front housing which defines said crank chamber.

6. The single-headed-piston type refrigerant compressor according to claim 1, wherein said cylindrical guide surface of said extended bore-forming portion of said cylinder block is coaxial with said corresponding cylinder bore.

* * * * *